US007762397B2

(12) United States Patent
Coltri-Johnson et al.

(10) Patent No.: US 7,762,397 B2
(45) Date of Patent: Jul. 27, 2010

(54) CARRIER PACKAGE

(75) Inventors: Andrea Coltri-Johnson, East Hanover, NJ (US); Jean-Manuel Gomes, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 326 days.

(21) Appl. No.: 11/622,184

(22) Filed: Jan. 11, 2007

(65) Prior Publication Data

US 2007/0158226 A1 Jul. 12, 2007

Related U.S. Application Data

(60) Provisional application No. 60/758,339, filed on Jan. 12, 2006.

(51) Int. Cl.
*B65D 65/00* (2006.01)

(52) U.S. Cl. ..... 206/429; 206/427; 206/434; 229/117.12

(58) Field of Classification Search ..... 206/427, 206/434, 188, 141, 162, 170, 174, 175, 193, 206/428, 429, 161, 147, 430, 431; 229/117.13, 229/117.12

See application file for complete search history.

(56) References Cited

U.S. PATENT DOCUMENTS 2,849,111 A 8/1958 Fielding
2,922,561 A * 1/1960 Currivan ..... 206/434
2,928,541 A 3/1960 Fielding
3,178,242 A 4/1965 Ellis
3,300,115 A 1/1967 Schauer
3,306,519 A 2/1967 Wood
3,339,723 A 9/1967 Wood
3,356,279 A 12/1967 Root
3,373,867 A 3/1968 Wood
3,593,849 A 7/1971 Helms
3,635,452 A 1/1972 Helms
3,669,342 A 6/1972 Funkhouser
3,747,835 A 7/1973 Graser
3,767,042 A 10/1973 Ganz
3,963,121 A 6/1976 Kipp
4,010,593 A 3/1977 Graham
4,101,069 A 7/1978 Wood
4,202,446 A 5/1980 Sutherland
4,328,893 A 5/1982 Oliff et al.
4,394,903 A 7/1983 Bakx
4,424,901 A 1/1984 Lanier
4,440,340 A 4/1984 Bakx
4,566,593 A 1/1986 Muller
4,747,487 A 5/1988 Wood
4,804,089 A 2/1989 Wilson
4,875,585 A 10/1989 Kadleck et al.
4,901,849 A * 2/1990 Wilson ..... 206/148

(Continued)

FOREIGN PATENT DOCUMENTS

BE 671.762 3/1966

(Continued)

*Primary Examiner*—Ehud Gartenberg
*Assistant Examiner*—Ernesto A Grano
(74) *Attorney, Agent, or Firm*—Womble Carlyle Sandridge & Rice, PLLC

(57) ABSTRACT

A wrap-around carrier package has handle features formed in a top panel of the package. The handle features allow a user to deform and grasp the top panel.

16 Claims, 4 Drawing Sheets

U.S. PATENT DOCUMENTS

| | | | | | |
|---|---|---|---|---|---|
| 4,919,266 | A | | 4/1990 | McIntosh et al. | |
| 4,966,324 | A | | 10/1990 | Steel | |
| 4,972,991 | A | * | 11/1990 | Schuster | 229/117.13 |
| 5,000,313 | A | | 3/1991 | Oliff | |
| 5,042,660 | A | | 8/1991 | Carver | |
| 5,060,792 | A | | 10/1991 | Oliff | |
| 5,131,588 | A | | 7/1992 | Oliff | |
| 5,180,100 | A | | 1/1993 | Shimizu | |
| 5,195,676 | A | | 3/1993 | LeBras | |
| 5,246,112 | A | | 9/1993 | Stout et al. | |
| 5,297,673 | A | | 3/1994 | Sutherland | |
| 5,351,878 | A | | 10/1994 | Cooper | |
| 5,421,458 | A | | 6/1995 | Campbell | |
| 5,472,090 | A | | 12/1995 | Sutherland | |
| 5,472,138 | A | | 12/1995 | Ingram | |
| 5,485,915 | A | | 1/1996 | Harris | |
| 5,505,372 | A | | 4/1996 | Edson et al. | |
| 5,542,536 | A | | 8/1996 | Sutherland | |
| 5,551,556 | A | | 9/1996 | Sutherland | |
| 5,558,212 | A | | 9/1996 | Sutherland | |
| 5,558,213 | A | | 9/1996 | Sutherland | |
| 5,597,071 | A | | 1/1997 | Sutherland | |
| 5,609,251 | A | | 3/1997 | Harris | |
| 5,664,401 | A | | 9/1997 | Portrait et al. | |
| 5,682,995 | A | | 11/1997 | Sutherland | |
| 5,692,614 | A | * | 12/1997 | Harris | 206/429 |
| 5,778,630 | A | | 7/1998 | Portrait et al. | |
| 5,853,088 | A | | 12/1998 | Saulas et al. | |
| 5,855,318 | A | | 1/1999 | Baxter | |
| 5,931,300 | A | | 8/1999 | Sutherland | |
| 5,937,620 | A | | 8/1999 | Chalendar | |
| 5,941,453 | A | | 8/1999 | Oliff | |
| 5,943,847 | A | | 8/1999 | Chalendar | |
| 5,947,367 | A | | 9/1999 | Miller et al. | |
| 5,975,286 | A | | 11/1999 | Oliff | |
| 6,019,220 | A | | 2/2000 | Sutherland | |
| 6,021,898 | A | | 2/2000 | Sutherland | |
| 6,021,899 | A | | 2/2000 | Sutherland | |
| 6,109,438 | A | | 8/2000 | Sutherland | |
| 6,155,480 | A | | 12/2000 | Botsford et al. | |
| 6,158,586 | A | | 12/2000 | Muller | |
| 6,227,367 | B1 | * | 5/2001 | Harrelson et al. | 206/427 |
| 6,289,651 | B1 | | 9/2001 | Le Bras | |
| 6,315,123 | B1 | | 11/2001 | Ikeda | |
| 6,550,616 | B2 | | 4/2003 | Le Bras | |
| 6,811,525 | B2 | | 11/2004 | Culpepper | |
| 6,866,185 | B2 | | 3/2005 | Harrelson | |
| 6,948,651 | B2 | | 9/2005 | Ikeda | |
| 6,981,631 | B2 | | 1/2006 | Fogle et al. | |
| 6,988,617 | B2 | | 1/2006 | Gomes et al. | |
| 7,007,800 | B2 | | 3/2006 | Le Bras | |
| 7,159,759 | B2 | | 1/2007 | Sutherland | |
| 7,448,492 | B2 | | 11/2008 | Sutherland | |
| 2003/0000182 | A1 | | 1/2003 | Portrait et al. | |
| 2003/0132130 | A1 | | 7/2003 | Bras | |
| 2004/0011674 | A1 | * | 1/2004 | Theelen | 206/188 |
| 2004/0089671 | A1 | | 5/2004 | Miller | |
| 2004/0188277 | A1 | | 9/2004 | Auclair | |
| 2004/0188301 | A1 | | 9/2004 | Gomes | |
| 2004/0243277 | A1 | | 12/2004 | Bonnain et al. | |
| 2004/0254666 | A1 | | 12/2004 | Bonnain et al. | |
| 2005/0001020 | A1 | | 1/2005 | Gamier | |
| 2005/0178791 | A1 | | 8/2005 | Miller | |
| 2005/0194430 | A1 | | 9/2005 | Auclair et al. | |
| 2006/0191811 | A1 | | 8/2006 | Fogle et al. | |
| 2006/0255108 | A1 | * | 11/2006 | Shmagin | 229/117.12 |

FOREIGN PATENT DOCUMENTS

| | | | |
|---|---|---|---|
| DE | 91 04 905.9 | | 6/1991 |
| DE | 92 03 858.1 | | 5/1992 |
| EP | 0 459 658 | A1 | 12/1991 |
| EP | 0 509 749 | A1 | 10/1992 |
| EP | 0520 411 | A1 | 12/1992 |
| FR | 2 698 074 | | 5/1994 |
| WO | WO 97/27124 | | 7/1997 |
| WO | WO 02/102208 | A1 | 12/2002 |
| WO | WO 03/008292 | A2 | 1/2003 |
| WO | WO 2005/042370 | A1 | 12/2005 |

* cited by examiner

CARRIER PACKAGE

RELATED APPLICATION

This application claims the benefit of U.S. Provisional Application No. 60/758,339, filed Jan. 12, 2006, which is hereby incorporated by reference in its entirety.

BACKGROUND

Wrap-around carrier packages are typically formed by wrapping a carrier blank around a group of containers and securing the ends of the blank together. The containers are held in place by the tightly wrapped carrier and also, typically, by heel cutouts through which the bottom portions of the containers extend. In conventional wrap-around carrier packages, however, handles are not provided, or when handles are provided, they typically reduce the integrity of the package.

SUMMARY

According to a first embodiment of the invention, a carrier package comprises a carrier having a top panel, a first side panel connected to the top panel, a second side panel connected to the top panel and disposed on a side of the carrier package opposite to the first side panel, a bottom panel, and at least partially open first and second ends. A plurality of containers are accommodated in the carrier package. One or more handles features are formed in the top panel. The handle features allow deformation of the edges of the top panel, which allows a user to easily lift and carry the carrier package. The handle features may be designed to allow deformation of the top panel without tearing, so that the integrity of the carrier package is not overly compromised.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Figure 1:
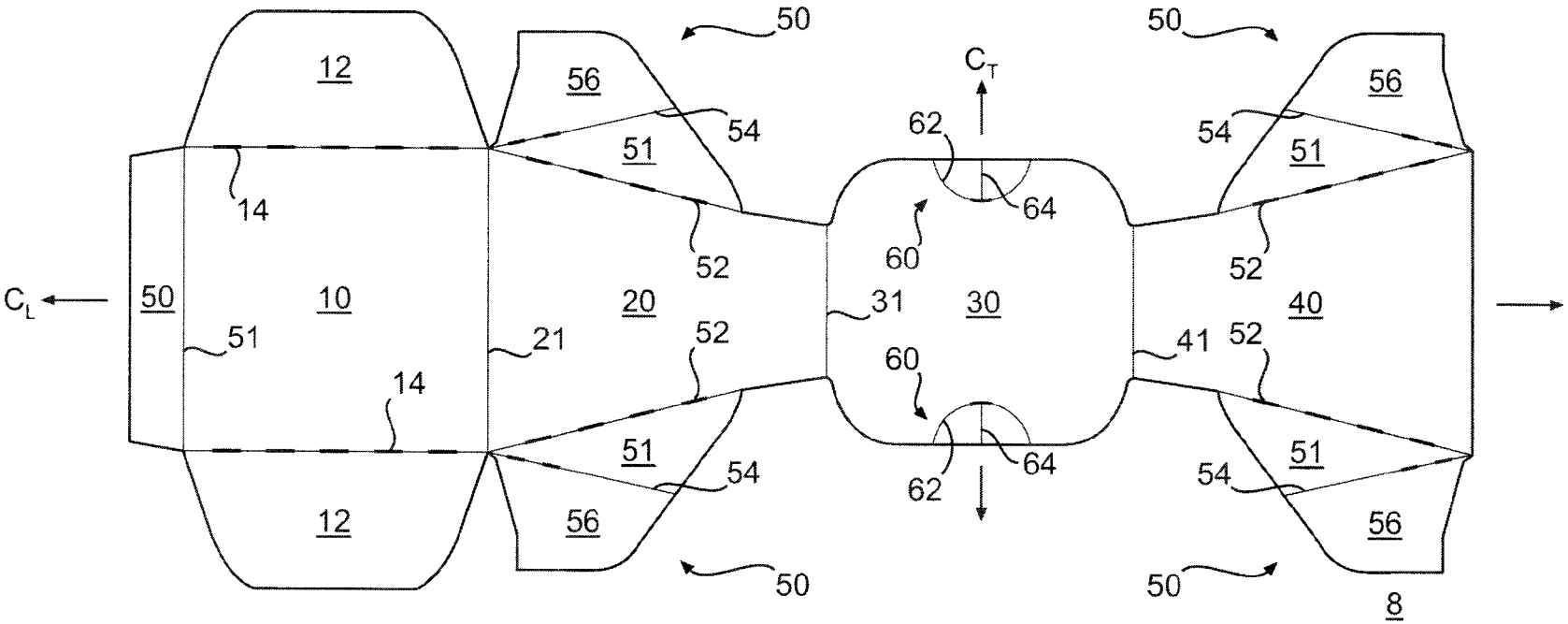
FIG. 1 is a plan view of a blank used to form a carrier package having handle features according to a first embodiment of the invention.

FIG. 1 is a plan view of a first side of a blank 8 used to form a carrier package 150 (illustrated in FIGS. 3-6) according to a first embodiment of the invention. As shown in FIG. 1, the carrier blank 8 may be wholly or partially symmetric about a longitudinal centerline $C_L$, and partially symmetric about a transverse centerline $C_T$. Therefore, certain elements in the drawing figures share common reference numerals in order to reflect the whole or partial longitudinal and/or transverse symmetries. The term "carrier package" generally refers to the erected carrier blank 8 and the containers C accommodated within the erected blank.

The blank 8 comprises a bottom panel 10 foldably connected to a first side panel 20 at a first transverse fold line 21, a top panel 30 foldably connected to the first side panel 20 at a second transverse fold line 31, and a second side panel 40 foldably connected to the top panel 30 at a third transverse fold line 41. An adhesive flap 80 may be foldably connected to the bottom panel 10 at a fourth transverse fold line 81. Alternatively, an adhesive flap may be connected to the second side panel 40 at the opposite end of the blank 8. The top panel 30 may have, for example, a generally square or rectangular shape with one or more rounded, beveled or truncated corners 33. The bottom panel 10 may be, for example, generally square or rectangular.

A bottom end flap 12 may be foldably connected to each end of the bottom panel 10 at longitudinal fold lines 14. The bottom end flaps 12 serve to partially close the ends of the carrier package 150 (illustrated in FIGS. 3-6). A web portion 50 may be foldably connected to each end of the first side panel 20 at an oblique fold line 52. A web portion 50 may also be foldably connected to each end of the second side panel 40 at an oblique fold line 52. Each web portion 50 comprises a first web panel 51 and a second web panel 56 foldably connected to the first web panel 51 at an oblique fold line 54. The web portions 50, along with the bottom end flaps 12, serve to partially close the ends of the carrier package 150. The orientation of the oblique fold lines 52 causes the side panels 20, 40 to taper inwardly toward the top panel 30.

According to one aspect of the present invention, one or more handle features 60 may be formed in the top panel 30 for lifting, grasping and/or carrying of the carrier package 150. In the illustrated embodiment, two handle features 60 are formed in the top panel 30, one handle feature 60 being formed at each end edge of the top panel 30. In the exemplary embodiment, each handle feature 60 comprises a perimeter line of disruption in the form of a curved or arcuate line 62, with the perimeter line 62 delimiting a handle section 67. In FIG. 1, the perimeter lines 62 are generally semicircular, although other shapes, including discontinuous perimeter lines having linear sections, are within the scope of the present invention. A transverse, intermediate line of disruption 64 may extend from an edge of the top panel 30 to a location at or adjacent to the perimeter line 62. Longitudinal cuts or score lines 66 may be formed along or adjacent to the perimeter lines of disruption 62, such as at the intersections of the intermediate lines 64 with the perimeter lines 62.

The perimeter lines 62 and the intermediate lines 64 may be designed to allow deformation of the top panel 30 at the lines of disruption 62, 64, while not actually promoting tearing of the top panel 30 at the lines 62, 64. The lines 62, 64 may be, for example, fold lines, score lines, crease lines, cut-space lines, combinations thereof, or other lines of disruption in the blank 8 allowing the top panel 30 to be deformed at the handle features 60. The perimeter lines 62 may be, for example, continuous, substantially continuous or discontinuous in the blank 8. The lines 66 can be cuts (e.g. slits) or scores at the apex of the perimeter lines 62 that facilitate pivoting of the handle section 67 when the top panel 30 is grasped at the handle features 60.

According to one exemplary method, the carrier package 150 can be erected from the blank 8 by lying the blank flat, and placing a plurality of containers C (shown in FIG. 2) top side down on the interior surface of the top panel 30. Glue or other adhesive may be applied to the exterior side of the adhesive flap 80 and/or to the interior side of the second side panel 40. Glue or other adhesive is also applied to the exterior sides of each of the second web panels 56 and/or to the interior sides of the bottom end flaps 12. The first and second side panels 20, 40 are folded upwardly about the transverse fold lines 31, 41, respectively, toward the sides of the inverted containers C. The adhesive flap 80 is folded about the transverse fold line 81 so that it is adjacent to the container bottoms. The bottom panel 10 is then folded about the transverse fold line 21 so that it is adjacent to the container bottoms and so that its interior side contacts the exterior side of the adhesive panel 80 and is adhered thereto by the adhesive. The blank 8 is now wrapped around the containers C and has a generally tubular form, with open ends. Each of the web portions 50 is folded inwardly about the fold lines 52 so that they extend across the open ends of the tubular form and so that they abut the sides of adjacent containers C. The bottom end flaps 12 are folded upwardly about the fold lines 14 so that they adhere to the exteriors of the second web panels 56 at each end of the carrier, as shown in FIGS. 2 and 3.

According to an alternative method of erection, the adhesive flap 80 may be pre-glued to the second side panel 40 by folding at the transverse fold lines 21, 41 so that the exterior side of the adhesive flap 80 contacts the interior side of the second side panel 40 and is adhered thereto. The pre-glued blank 8 may then be opened up into a generally tubular form, and the containers C transversely loaded into the tubular form through an open end of the blank. The open ends of the tubular form may then be closed by the web panels 51, 56 and the bottom end flaps 12.

Figure 2:
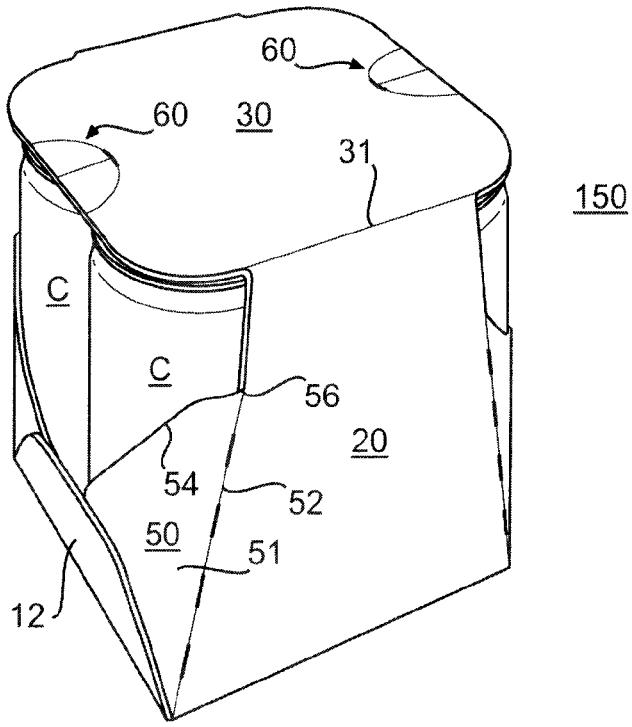
FIGS. 2 and 3 illustrate the carrier package loaded with containers.
Figure 3:
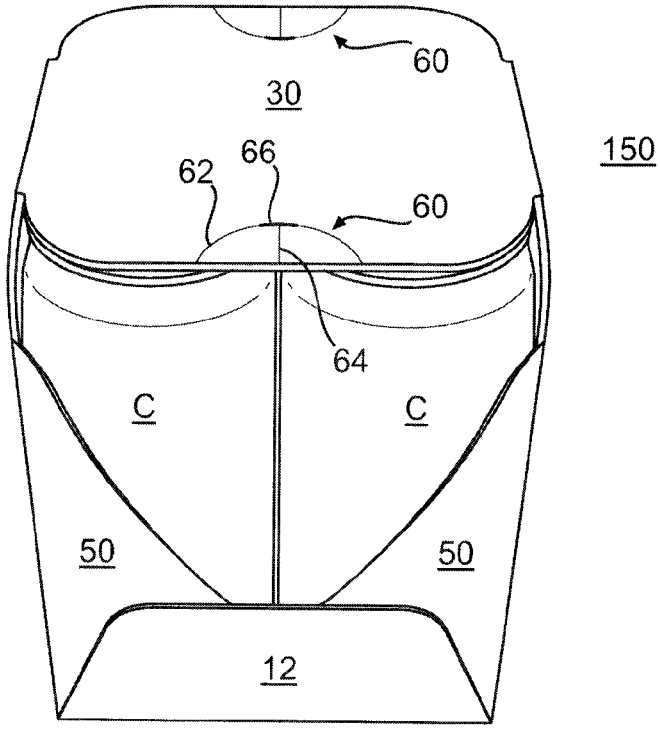

Referring to FIGS. 2 and 3, the erected carrier package 150 includes the containers C securely retained therein, with the longitudinal axes of the generally cylindrical containers being perpendicular to the top and bottom panels 10, 30. The exemplary carrier package 150 includes four beverage containers C arranged in a 2×2 arrangement, although other container arrangements are within the scope of the invention.

As shown in FIGS. 2 and 3, the ends of the carrier package 150 may be partially open, exposing upper portions of the sides of the containers C to view. The sides of the carrier package 150 are substantially closed by the tapered first and second side panels 20, 40. During erection, the carrier package 150 can be wrapped relatively tightly around the containers C so that the web portions 50 slightly bend or otherwise deform at the lines of disruption 54, which in turn causes the panels 51, 56 to partially conform to the exterior surfaces of adjacent containers C. In the illustrated embodiment, the web portions 50 and the bottom end flaps 12 close a substantial portion of the lower ends of the carrier package 150. The degree to which the ends of the carrier package 150 are closed may be varied, for example, so that varying degrees of the containers C are visible.

Figure 4:
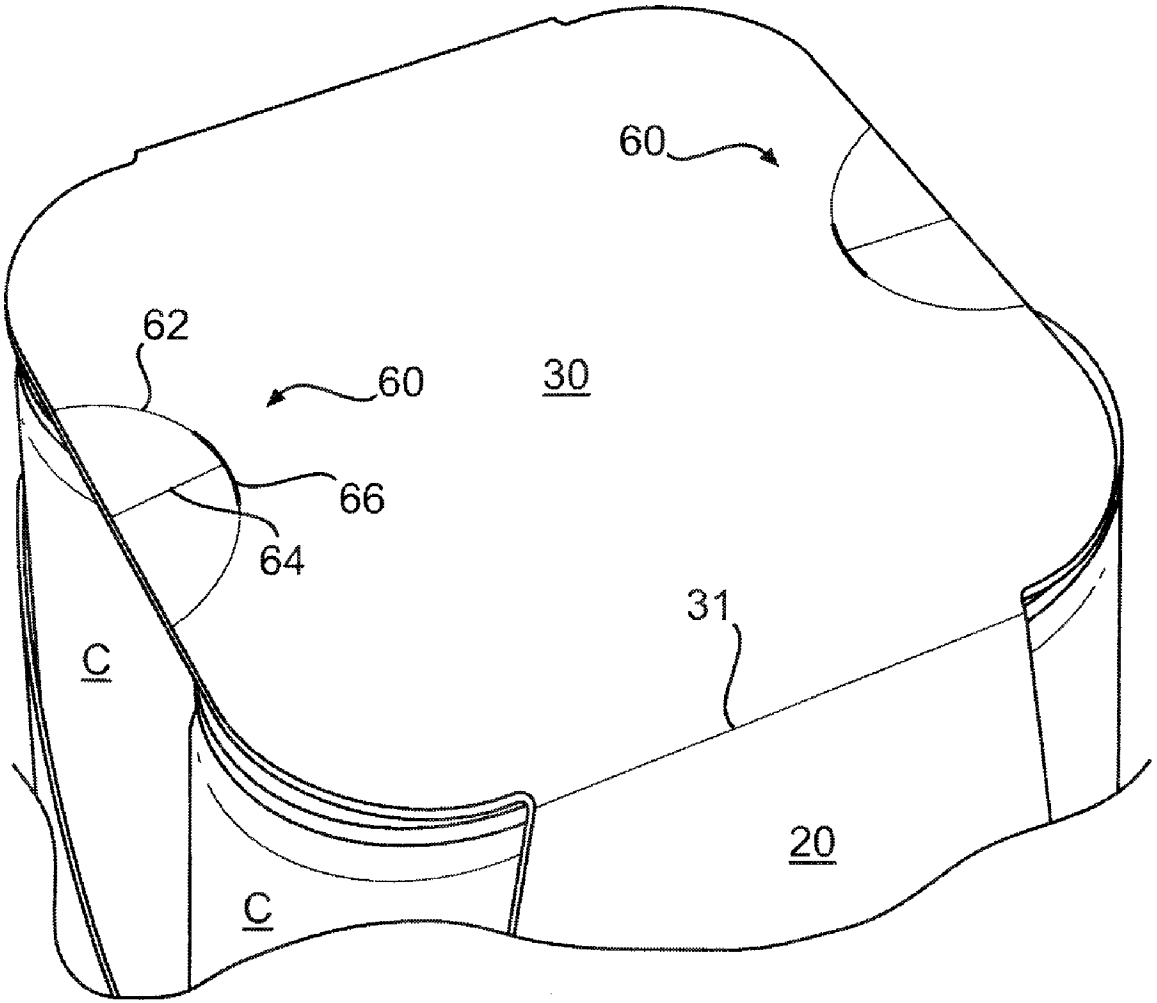
FIG. 4 is a partial view of the carrier package illustrating the top panel of the carrier package.

FIG. 4 is a partial view of the carrier package 150 illustrating the top panel 30. The handle features 60 are arranged in the top panel 30 for lifting, grasping and/or carrying of the carrier package 150. Each handle feature 60 provides a location at which the top panel 30 can be deformed according to a predetermined pattern in order to facilitate grasping of the carrier package 150. Each handle feature 60 is located at an edge of the top panel 30, adjacent to a partially open end of the carrier package 150. Additional handle features may be, for example, located at other parts of the top panel 30, such as at or adjacent to the fold lines 31, 41.

Figure 5:
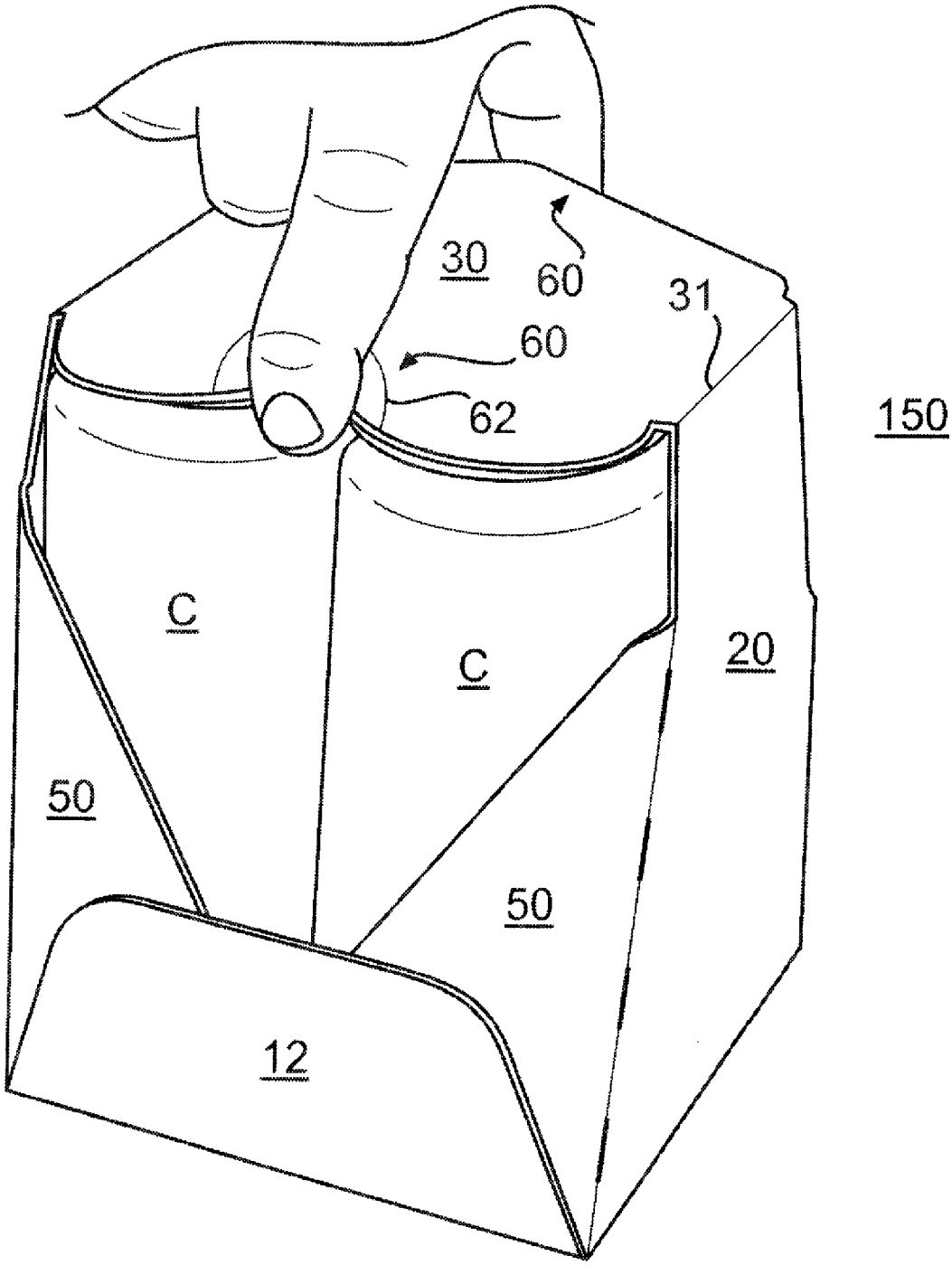
FIG. 5 illustrates the carrier package being grasped at the handle features and lifted.

FIG. 5 illustrates a user accessing the handle features 60 in the top panel 30. The carrier package 150 may be grasped by placing opposed fingers on the end edges of the top panel 30 at the handle sections 67, and squeezing the top panel 30 inwardly. Squeezing the top panel 30 at the handle features 60 causes the top panel 30 to deform inwardly at the opposed end edges of the top panel 30. Referring also to FIG. 4, the handle sections 67 may deform such that they pivot about the lines 62, 66, and bend inwardly at the lines 64. The handle features 60 may be located in the top panel 30 between adjacent containers C so that the handle sections 67 deform inwardly without interference from the containers C. Deformation of the top panel 30 provides a secure grip for lifting of the carrier package 150.

The exemplary carrier package 150 is illustrated as accommodating generally cylindrical 8.3 fluid ounce beverage cans. Other types of containers, however, can be accommodated within carrier packages according to the present invention. Generally cylindrical 12 ounce beverage cans, for example, could be used. The dimensions of the blank 8 may generally be altered to accommodate various container forms.

Additional containers C can be accommodated in a carrier package according to principles of the present invention, for example, by adjusting the length of the blank 8. For example, the top panel 30, the bottom panel 10 and the bottom end flaps 12 can be lengthened along the longitudinal direction of the blank 8 (measured from left to right in FIG. 1) in order to accommodate additional containers C. In one such alternative embodiment, a carrier package may be constructed that accommodates six containers arranged in three rows and two columns (3×2).

The blank according to the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect information printed on the blank. The blank may also be coated with, for example, a moisture barrier layer, on either or both sides of the blank.

In accordance with the exemplary embodiments, the blank may be constructed of paperboard of a caliper such that it is heavier and more rigid than ordinary paper. The blank can also be constructed of other materials, such as cardboard, hard paper, or any other material having properties suitable for enabling the carrier package to function at least generally as described above. The blank can also be laminated to or coated with one or more sheet-like materials at selected panels or panel sections.

For purposes of the description presented herein, the term "line of disruption" can be used to generally refer to, for example, cut lines, score lines, crease lines, tear lines, fold lines, and combinations thereof, formed in a blank.

A fold line can be any substantially linear, although not necessarily straight, form of disruption or weakening in the blank that facilitates folding therealong. More specifically, but not for the purpose of narrowing the scope of the present invention, examples of fold lines include: score lines; crease lines; a cut or a series of cuts that extend partially into and/or completely through the material along a desired line of weakness; and various combinations of these features.

The above embodiment may be described as having one or panels adhered together by glue. The term "glue" is intended to encompass all manner of adhesives commonly used to secure various portions of the blank.

The description is not intended to limit the invention to the form disclosed herein. Also, it is intended that the appended claims be construed to include alternative embodiments, not explicitly defined in the detailed description.

What is claimed is:

1. A carrier package, comprising:

a bottom panel;

a top panel;

a first side panel;

a second side panel;

an at least partially open first end;

an at least partially open second end;

at least one handle feature in the top panel, the handle feature allowing deformation of the top panel without tearing so that the integrity of the carrier package is maintained at at least one free end edge of the top panel, the at least one free end edge comprising an edge of the top panel, and the at least one handle feature comprising a handle section defined by a perimeter fold line in the top panel, and an intermediate fold line in the handle section, wherein the perimeter fold line comprises at least one portion that extends to the at least one free end edge of the top panel, the intermediate fold line extends from the perimeter fold line to the edge of the top panel, and the deformation of the top panel comprises pivoting of the handle section without tearing along the length of the perimeter fold line; wherein the handle feature comprises a cut line, and the at least one portion of the perimeter fold line comprises a first arcuate fold line extending from the cut line to the at least one free end edge and a second arcuate fold line extending from the cut line to the at least one free end edge; and a plurality of containers.

2. The carrier package of claim 1, wherein the first end of the carrier package is at least partially closed by a first bottom end flap.

3. The carrier package of claim 2, wherein the first end of the carrier package is at least partially closed by a first web portion foldably connected to the first side panel and a second web portion foldably connected to the second side panel.

4. The carrier package of claim 3, wherein the first web portion comprises:

a first web panel foldably connected to the first side panel; and a second web panel foldably connected to the first web panel, the second web panel being adhered to the first bottom end flap.

5. The carrier package of claim 4, wherein the at least one handle feature further comprises a cut or score at or adjacent to the first perimeter fold line.

6. The carrier package of claim 3, wherein the plurality of containers comprises at least four generally cylindrical containers.

7. The carrier package of claim 6, wherein the containers are arranged in a two by two arrangement.

8. The carrier package of claim 1, wherein the at least one handle feature further comprises a cut line that is generally collinear with a portion of the perimeter fold line, wherein the cut line is for facilitating pivoting of the handle section.

9. The carrier package of claim 1, wherein the plurality of containers comprises four generally cylindrical containers arranged in a two by two arrangement, wherein each container has a longitudinal axis, the longitudinal axes of the containers being generally perpendicular to the bottom panel.

10. The carrier package of claim 1, wherein the first and second side panels taper inwardly towards the top panel.

11. The carrier package of claim 1, wherein the at least one handle feature comprises a first handle feature at a first end edge of the top panel and a second handle feature at a second end edge of the top panel.

12. A method of carrying a carrier package, comprising:

providing a carrier package according to claim 11;

placing at least one finger on the top panel at the first handle feature;

placing at least one finger on the top panel at the second handle feature;

deforming the top panel at the first and second handle features; and lifting the carrier package.

13. A blank, comprising:

a bottom panel;

a first bottom end flap foldably connected to a first end of the bottom panel;

a second bottom end flap foldably connected to a second end of the bottom panel;

a top panel;

a first side panel;

a second side panel;

a first web portion foldably connected to a first end of the first side panel;

a second web portion foldably connected to a second end of the first side panel; and a deformable first handle feature in the top panel and adapted for deformation of the top panel without tearing so that the integrity of the carrier package is maintained at a first free end edge of the top panel, the first handle feature comprising a handle section in the top panel defined by a perimeter fold line, and an intermediate fold line in the handle section, wherein the perimeter fold line comprises at least one portion that extends to the first free end edge of the top panel, the intermediate fold line extends from the perimeter fold line to the first free end edge of the top panel, and the first handle feature is adapted for deformation of the top panel without tearing along the length of the perimeter fold line, wherein the at least one handle feature comprises a cut line that is generally collinear with a portion of the perimeter fold line, the cut line being for facilitating pivoting of the handle section, wherein the at least one portion of the perimeter fold line comprises a first arcuate fold line extending from the cut line to the first free end edge and a second arcuate fold line extending from the cut line to the first free end edge.

14. The blank of claim 13, wherein the intermediate fold line extends from the cut line to the first end edge of the top panel.

15. The blank of claim 13, wherein the first web portion comprises:

a first web panel foldably connected to the first side panel; and a second web panel foldably connected to the first web panel.

16. The blank of claim 13, wherein the first and second side panels taper inwardly toward to the top panel.

* * * * *